US007496970B2

(12) United States Patent
Gors

(10) Patent No.: US 7,496,970 B2
(45) Date of Patent: Mar. 3, 2009

(54) BIB/CARRYING-RECEPTACLE

(76) Inventor: Donald Gors, 5701 N. Sheridan Rd., #Unit 30 A, Chicago, IL (US) 60660

( * ) Notice: Subject to any disclaimer, the term of this patent is extended or adjusted under 35 U.S.C. 154(b) by 228 days.

(21) Appl. No.: 11/510,217

(22) Filed: Aug. 25, 2006

(65) Prior Publication Data

US 2008/0060108 A1 Mar. 13, 2008

(51) Int. Cl.
*A41B 13/10* (2006.01)

(52) U.S. Cl. ..... 2/49.2

(58) Field of Classification Search ..... 2/49.1–49.5, 2/48, 51, 52; 206/170, 541, 550, 542, 546, 206/548, 549; 383/105, 111, 114; 224/148.1
See application file for complete search history.

(56) References Cited

U.S. PATENT DOCUMENTS 2,364,258 A * 12/1944 Wallace ..... 2/92
2,704,625 A * 3/1955 Huse ..... 224/576
4,114,199 A * 9/1978 Malan ..... 2/49.3
4,941,756 A * 7/1990 Price ..... 383/127
4,946,094 A * 8/1990 Stang ..... 224/270
5,056,159 A * 10/1991 Zemke, Jr. ..... 2/46
5,062,558 A * 11/1991 Stang ..... 224/270
5,642,674 A * 7/1997 Joye et al. ..... 108/43
6,530,089 B2 * 3/2003 Frye ..... 2/49.2
6,826,780 B1 * 12/2004 Romesburg ..... 2/49.2
7,360,256 B1 * 4/2008 Jiles et al. ..... 2/49.1
2006/0174390 A1 * 8/2006 Wakhloo et al. ..... 2/48
2007/0061939 A1 * 3/2007 Rose ..... 2/49.1

* cited by examiner

*Primary Examiner*—Amy B Vanatta
(74) *Attorney, Agent, or Firm*—Cherskov & Flaynik

(57) ABSTRACT

A food receptacle (such as a bag, a pouch, or a box) and bib combination is provided, the combination comprising a receptacle, a bib integrally formed with said receptacle so as to be contained in said receptacle in a first configuration, such as the case when the receptacle is used as a food transport container; and surfaces for directing food from said bib to an opening in said receptacle when the bib is positioned outside of the receptacle in a second configuration, such as the case when the bib is covering a user.

18 Claims, 2 Drawing Sheets

BIB/CARRYING-RECEPTACLE

FIELD OF THE INVENTION

The present invention relates to the field of travelers' bibs for consuming food and drinks and, more specifically, the present invention relates to the field of bibs that are integral to and extend from food carrying means.

BACKGROUND OF THE INVENTION

There are many circumstances when one needs to be able to consume food away from a table and also to be able to carry food, drinks, and other implements. These circumstances include when one travels on a plane, in a car, a train, a boat, or a bus or when one is hiking or on a picnic, or when one is bedridden, or when one has purchased food at a fast-food outlet, or when one is at a crowded venue such as a sport event, party, etc. It is very difficult to eat or drink without spilling food or drink onto oneself. Also, under these same consequences, one needs a convenient carrying means for the food and drink that are to be consumed.

Efforts have been made to design a device that would first provide a means to transport food and second a means for preventing food from spilling on the consumer when eating. Finally, it would be especially advantageous if the device is disposable.

Many devices combine a bag with a bib, for example, U.S. Pat. No. 5,244,278 (Robitaille) and U.S. Pat. No. 5,530,968 (Crockett). However, these designs have the disadvantage of providing only limited protection to the wearer because they cover only a limited portion of the wearer's chest and lap.

U.S. Pat. No. 5,483,701 (Ferreyros) also discloses a bib and a pouch. However, the pouch does not catch crumbs or other debris spilled by the user.

Thus, there is a need in the art for a combination of a bib and a food carrying receptacle that provides adequate protection to the wearer while consuming food and drink. The bib/receptacle combination should also provide a means to carry food, drink, and other objects before consumption and a catch-all for left-overs, utensils, spill-overs and refuse after consumption so as to keep the surroundings free of litter. Finally, it would be especially advantageous if the device is disposable.

SUMMARY OF THE INVENTION

An object of the present invention is to provide a bib/receptacle combination that overcomes many of the disadvantages of the prior art.

Another object of the present invention is to provide a bib/receptacle combination that, when used as a bib, directs spilled food to a specific location. A feature of the present invention is that it comprises a plurality of surfaces, some of which conform to a user's body, to guide food particles and fluids generally into a receptacle such as a pouch, a bag, or a box. Another feature is that the opening of the pouch or receptacle can be adjusted to fit the size of the user, while simultaneously enhancing the ability of the device to deflect food into the pouch or receptacle. An advantage of the present invention is that it maximizes coverage of a user.

Still another object of the present invention is to provide a bib/receptacle combination that is disposable. A feature of the present invention is that it may be constructed of a single material so as to be homogeneous in construction. An advantage of the present invention is that it can be fabricated inexpensively. When constructed from disposable materials, the present invention can be used to collect all left-over food, empty containers, and other waste, as well as store this refuse until the invented device and its contents can be disposed of together.

In brief, this invention generally discloses a bib/receptacle combination adapted to permit carrying and consumption of food while simultaneously preventing spilled food from contacting the eater or his or her surroundings. This bib/receptacle combination comprises a receptacle such as a pouch, bag, or box that collects spilled food as well as means to channel spilled food into that receptacle, while food is being eaten by the wearer of the device.

Specifically, the invention provides a food receptacle and bib combination, the combination comprising a receptacle such as a pouch, bag, or box; a bib integrally formed with said receptacle so as to be contained in said receptacle in a first configuration, such as the case when the receptacle is used as a food transport container; and a means for directing food from said bib to an opening in said receptacle when the bib is positioned outside of the receptacle in a second configuration, such as the case when the bib is covering a user.

Also provided is a storage receptacle and bib combination comprising a first receptacle such as a pouch, bag, or box having a front side, a back side, and a top side defining a mouth; a substrate attached to the top side and back side so as to define a second receptacle wherein a portion of the substrate is partially isolated from the environment; an elongated member attached to said portion of the substrate so as to facilitate removal of that portion from the second receptacle; and a means for reversibly attaching said portion to a user.

BRIEF DESCRIPTION OF THE DRAWING

The invention together with the above and other objects and advantages will best be understood from the following detailed description of the preferred embodiment of the invention shown in the accompanying drawing, wherein.

DETAILED DESCRIPTION OF THE INVENTION

The present invention discloses a bib/receptacle combination adapted to permit first, carrying and second, consumption of food while preventing spilled food from coming into contact with the eater or his surroundings. This bib/receptacle configuration comprises a receptacle such as a pouch, bag, or box that collects spilled food as well as means to channel spilled food from surfaces of a deployed bib into the receptacle.

When used as a carrying receptacle, the proposed bib/receptacle combination provides a convenient means for transporting food, drinks, napkins, eating implements and the like. In such a configuration, the bib, still undeployed, resides in the receptacle, with any food items also contained therein.

As noted supra, the device can take the form of a bag and thus can be constructed from a single material, and as such can be produced using blown film extrusion. Characteristics of blown film extrusion processes enable the bib to remain in static and frictional engagement with an inside surface of the receptacle and therefore out of the way of harried fast food restaurant workers filling the receptacle. To deploy the bib from the receptacle, the user simply peels the bib portion away from the inside surface of the receptacle.

Alternatively, the bib is reversibly attached to the receptacle via a tongue and groove arrangement, hook-and-pile arrangement, snaps, or the like. In another alternative embodiment an exterior or interior surface of the receptacle may define a separate compartment in which the bib can be stored until deployment. This arrangement minimizes contact between the bib and the food transported in the receptacle.

Figure 1:
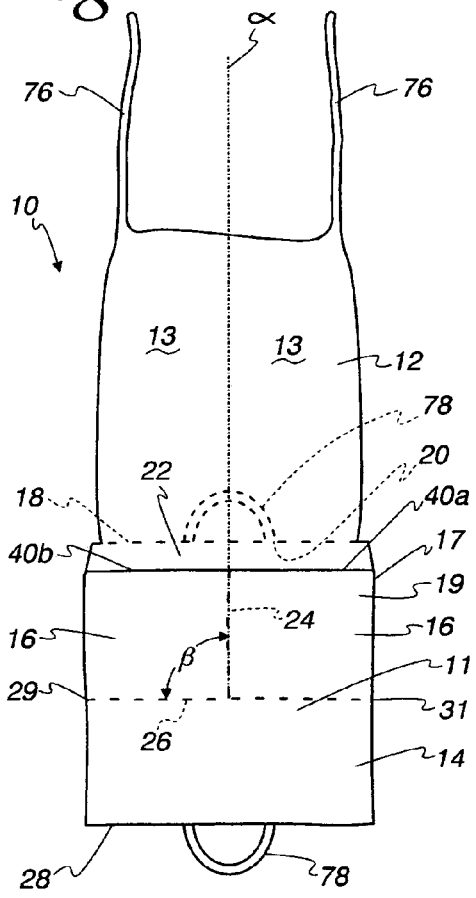
FIG. 1 is a plan view of a bib/receptacle combination, in accordance with features of the present invention.

The resulting deployed configuration is depicted in FIG. 1. The invention is designated generally as numeral 10. It should be noted that the embodiments depicted in FIGS. 1, 2, 3, and 4 are merely illustrative and not meant to restrict the invention thereto.

As depicted in FIG. 1, three salient features of the device include a bib surface 12, a receptacle 11 such as a pouch, bag, or box positioned inferior from the bib surface, and ties 76 with which to anchor the device about the user's neck. Optionally, the device may include handles 78 to facilitate carrying the device.

The invented device could be fabricated using any one of a variety of materials. Alternatively, several materials could be incorporated into a single device. Materials including, but not limited to, plastic (including polyolefins, ethylene copolymers, PVC, nylon, elastomers, nitrites, PETG and polycarbonates), thermally insulating materials, paper, cardboard, paper (or cardboard) coated with a liquid-proof layer, cardboard, can each be used singly or in combination. The receptacle 11 itself may be made of paper or cardboard and the bib 12 of plastic, with the two joined by an adhesive or otherwise. The receptacle 11 may be made waterproof.

Bib Detail

The bib may be either detachable from the receptacle 11 or else integrally molded thereto. In the situation where the bib is detachable, a score line 18 extending laterally so as to be perpendicular to the longitudinal axis $\alpha$ of the device, and defining a depending edge 20 of the bib facilitates removal of the bib from the receptacle 12. Alternatively, the region defining the score line could instead define a region where the bib is reversibly attached to the receptacle using the various fastener means discussed supra.

In an alternative embodiment, the depending edge 20 of the bib defines a fold line at which point the bib is integrally molded and folded inside the receptacle before deployment. In this alternative configuration, the bib when unfolded extends beyond the score line and terminates approximately at the mid-thigh or knee region of the user.

Two elongated extending portions of the bib serve as the neck-encircling ties 76 and are attached to the bib at an edge distal from the first or bottom receptacle 14.

Exterior, outwardly facing surfaces 13 of the bib may be used as an advertising medium, indicating where the food was bought or bearing other information.

Receptacle Detail

The receptacle 11 such as a pouch, bag, or box is constructed so as to define a first upwardly facing mouth 22.

There will be situations where the device is worn while the user is consuming particularly unwieldy food, like crumbling Danish, or loosely formed food, such as over-stuffed sandwiches (i.e. Italian Beef) or condiments-topped hot dogs. In such instances, the user wants maximum coverage of his or her lap and clothing.

Figure 2:
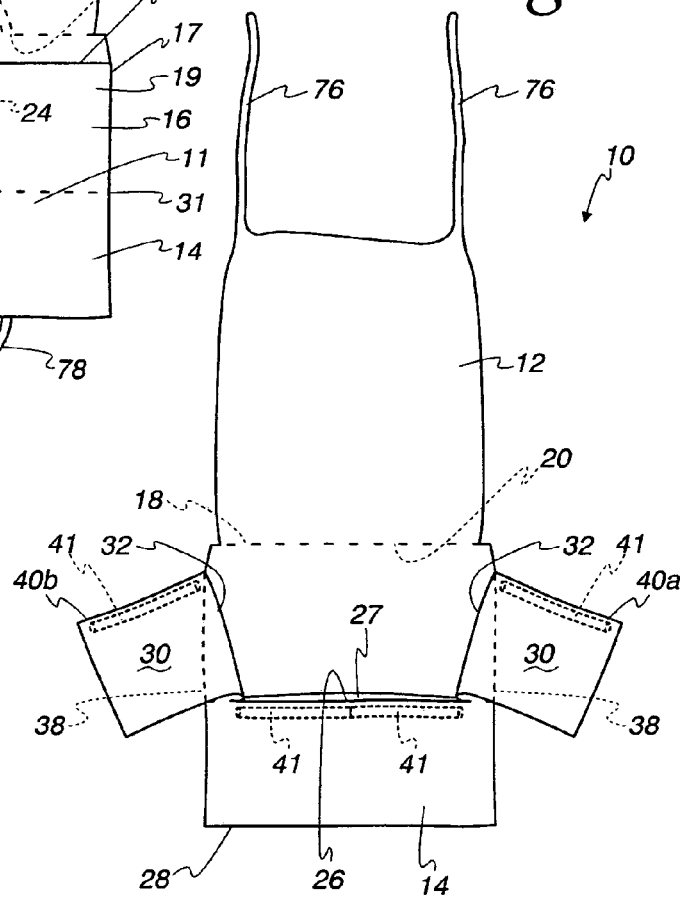
FIG. 2 is a plan view of a bib/receptacle combination in a fully deployed configuration, in accordance with features of the present invention.

To funnel falling food into the device, and to simultaneously maximize garment protection, the device further contains additional score lines as a means to expand the "footprint" of its protective covering by converting an upper portion 19 of the receptacle 11 into a broad garment protective cover. FIG. 2 depicts the device in such a deployed fashion.

Outwardly facing surfaces 16 of the receptacle 11 contain a second score line 24 to facilitate a lateral separation of the outwardly facing receptacle surface 16 along the device's medial line (i.e. along longitudinal axis $\alpha$). This second score line 24, extending along the medial line of the first receptacle, terminates approximately halfway between the first mouth 22 of the receptacle 11 and a depending edge 28 or the bottom of the receptacle 11.

A third score line 26, having a first lateral end 29 and second lateral end 31 extends medially (i.e., towards the center line a of the device) so as to intersect the second score line at approximately a 90 degree angle $\beta$ and at the termination point of the second score line. Alternatively, the third score line can intersect the second score line at an acute angle, or an obtuse angle. Flaps 30 are formed from outwardly facing surfaces of the first receptacle when the second score line 24 and third score line 26 are separated. These flaps can be folded out to cover the lap of the user, thereby providing a means for enhanced clothing protection from falling food. The flaps are configured so as to overlay regions of the pants or skirt of the user extending beyond the original lateral margins 38 of the receptacle. When the device is so deployed, the receptacle 11 is reduced to a bottom portion 14. The score lines 24 and 26 are such that the receptacle surfaces 16 may be separated to a variable degree.

The device provides even more clothing protection and food bit isolation when the score lines 24, 26 are utilized to form a second upwardly-facing mouth 27 using the bottom receptacle portion 14. Specifically, the flaps 30, when laid open, expose more of the interior of the bottom portion 14 of the receptacle 11 and create angled lips 32 each of which extend inwardly and downwardly to serve as a funnel to direct any food pieces to a newly formed larger opening 27 of the lower portion 14 of the receptacle 11. The lips 32 extend laterally toward the midline a of the device and downwardly from the sides of the device where the first mouth 22 of the receptacle 11 intersects the lateral margin 38 of the receptacle 11. A depending end of each of the lips terminate at the lateral ends of the third scored line 26.

In light of the foregoing, the device provides two mouths and, in effect, two receptacles. The first mouth 22 is located at the space between the bib edge 20 and the opposing receptacle edges 40*a*, 40*b*, with the score line 24 remaining closed (See FIG. 1).

Alternatively, if the device user so chooses, the second mouth 27 (See FIG. 2) is provided and is formed at a point inferior from the original position of the mouth 22 so as to be approximately halfway between the bottom 28 of the original receptacle 11 and the top 17 of the original receptacle 11. This second mouth 27 forms concurrently with the deployment of the flaps 30 from the laterally extending score line 26.

The first receptacle 11 formed from the first mouth 22, and/or the second receptacle formed from the bottom portion 14 of the receptacle 11 may be kept open by a variety of means. If the periphery of the receptacle defining its upwardly facing mouth is fabricated from sufficiently stiff paper, or paper and wire, or cardboard, the paper may be bent and creased so as to form the desired mouth.

If the device is fabricated from plastic, then heavy-paper or cardboard staves (not shown), or similar curve-shaped elongate flat substrates, may be positioned proximal to the mouth so as to conform a portion of the mouth of the receptacle as a convex protrusion from the plane formed from the bib. This protrusion serves as a means to keep the mouth open. For example, in one embodiment, regions of the periphery of the receptacle defining the mouth form laterally extending channels 41 which slidably receive the staves. The channels 41 are positioned so as to be in close spatial relation to the mouths of the receptacles and generally parallel to edges 40*a* and 40*b* of the receptacle 11 forming the first mouth 22 and/or the edges 26 of the receptacle forming the second mouth 27. Once inserted, the longitudinal sides of the staves, extend generally perpendicularly relative to the longitudinal axis $\alpha$ of the device, thereby conforming the mouth to the shape of the staves. The staves may be reversibly deformable, thereby providing a method for forming the top of the funnel to a shape with a defined periphery.

Figure 3:
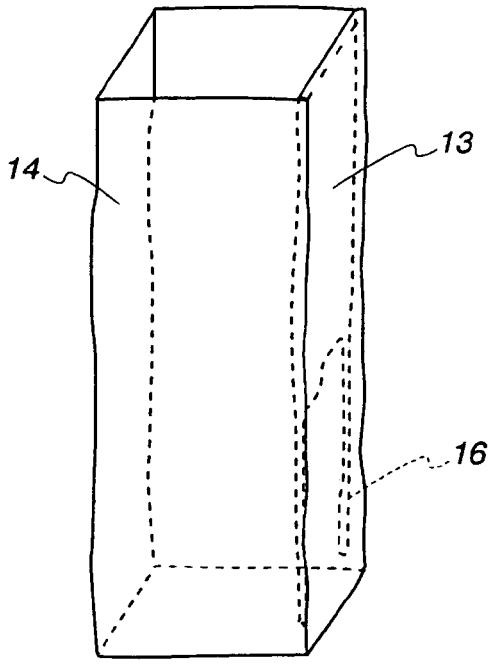
FIG. 3 is a profile view of the invented bib/receptacle combination with the bib in an undeployed configuration, in accordance with features of the present invention.

FIG. 3 depicts an undeployed configuration of the invented bib/receptacle combination.

As noted supra, certain economies are achieved if the device is constructed of all one material so as to be homogenous in construction. However, the invented device also can be constructed with more than one type of material, so as to be heterogeneous in construction. In this heterogeneous situation, a pre-fabricated receptacle is either reversibly or permanently attached to a bib. Permanent attachment may be made via adhesive or IR welding.

Figure 4:
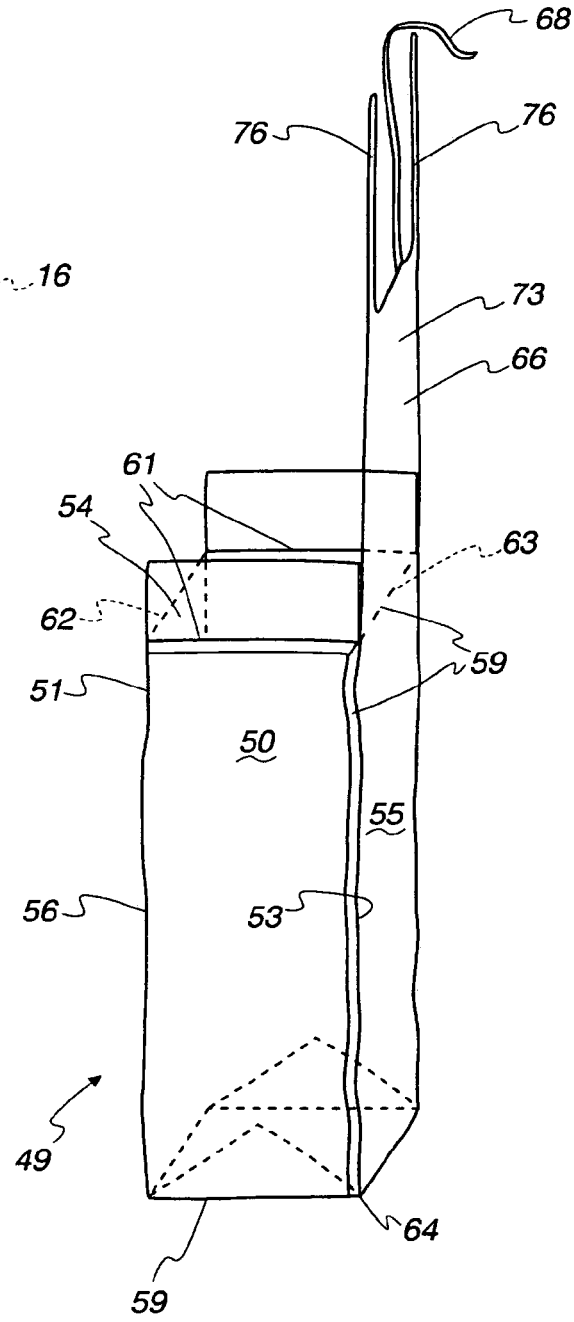
FIG. 4 is a perspective view of an alternate embodiment of a bib/receptacle combination in a fully deployed configuration, in accordance with features of the present invention.

An exemplary embodiment of a paper or cardboard box receptacle-plastic bib combination 49 is shown in FIG. 4. FIG. 4 is a perspective view of the device. As shown in FIG. 4, the device comprises a paper or cardboard receptacle 50 having a front outwardly facing surface 56, and a back, wearer-facing surface 53. The receptacle further comprises a first top end 51 having lateral side lips 61, a front lip 62 and a back lip 63. The sides and lip define a mouth 54. The receptacle further comprises a bottom end 52, whereby the bottom end intersects the back, wearer-facing surface 55 along edge 64.

A substrate 55 resembling a web or sheet is attached to dorsal edges of the lateral side lips 61 and top and bottom edge 64 of the receptacle. The upwardly extending plastic substrate 66 is attached to the surface 53, is integrally molded with the substrate, and forms a bib portion 66 of the heterogeneously constructed device. The attachment of the plastic substrate to the receptacle 50 is such that a receptacle pocket 59 is formed between the wearer facing surface 53 of the receptacle 50 and the substrate 55, so as to house the upwardly extending bib portion 66 of the substrate when the device is not in use. Optionally, a strap 68 is attached to the upwardly extending portion 66 of the substrate to facilitate deployment of the bib from the receptacle pocket 59 by the user pulling on the strap 68. Also optionally, the receptacle 50 may comprise carrying handles 79 attached to or extending from the side lips 61.

The receptacle pocket 59 serves as a means for isolating the bib from food and liquids stored in the receptacle 50, as insurance in those instances where the fast food attendant inadvertently soils the receptacle with the food or liquid.

While the invention has been described in the foregoing with reference to details of the illustrated embodiment, these details are not intended to limit the scope of the invention as defined in the appended claims.

The embodiment of the invention in which an exclusive property or privilege is claimed is defined as follows:

1. A food receptacle and bib combination, the combination comprising:

a) a receptacle defining a first mouth;

b) a bib attached to said receptacle so as to be contained in said receptacle in a first configuration wherein the bib comprises a flexible material; and c) flaps formed from inwardly facing surfaces of the receptacle and defining angled lips extending inwardly and downwardly for directing falling food from said bib to a second mouth position inferior to said first mouth when the bib is positioned outside of the receptacle in a second configuration, such as the case when the bib is covering a user; wherein the flaps extend beyond the original lateral margins of the receptacle.

2. The combination as recited in claim 1 wherein the bib is removable from said receptacle.

3. The combination as recited in claim 1 wherein the receptacle further comprises a means for increasing the opening.

4. The combination as recited in claim 1 wherein the second mouth is variable.

5. The combination as recited in claim 1 wherein said bib is integrally molded with said receptacle.

6. The combination as recited in claim 5 wherein the receptacle and bib are constructed from the same material.

7. The combination as recited in claim 1 wherein said receptacle is a box.

8. The combination as recited in claim 1 further comprising carrying handles attached to said receptacle.

9. A storage receptacle and bib combination comprising:

a) a bottom receptacle portion having a front side, a back side, and a top side defining a mouth; and b) a substrate attached to the back side so as to define a second receptacle wherein a portion of the substrate is partially isolated from the environment;

c) an elongated member attached to the portion of the substrate so as to facilitate removal of the portion of the substrate from the second receptacle wherein flaps are formed from inwardly facing surfaces of the second receptacle and extend beyond the original lateral margins of the second receptacle; and d) a means for reversibly attaching the portion to a user.

10. The combination as recited in claim 9 wherein the bottom receptacle portion and the substrate comprise one material as to be homogenous in construction.

11. The combination as recited in claim 9 wherein the bottom receptacle portion and the substrate comprise different materials.

12. The combination as recited in claim 9 wherein the bottom receptacle portion further comprises a means for increasing the mouth.

13. The combination as recited in claim 12 wherein the means for increasing the mouth further includes a means for simultaneously increasing coverage of the user.

14. The combination as recited in claim 9 wherein the mouth is variable.

15. The combination as recited in claim 9 wherein the bottom receptacle portion comprises carrying handles.

16. The combination as recited in claim 9 wherein the bottom receptacle portion is a box.

17. The combination as recited in claim 9 wherein the bottom receptacle portion is waterproof.

18. The combination as recited in claim 9 wherein the bottom receptacle portion comprises thermally insulating materials.

* * * * *